United States Patent [19]

Ueda et al.

[11] 4,272,837

[45] Jun. 9, 1981

[54] ELECTRONIC TIMEPIECE WITH ROTATION DETECTOR

[75] Inventors: Makoto Ueda; Akira Torisawa; Katsuhiko Satoh; Masaharu Shida; Masaaki Mandai; Kazuhiro Asano, all of Tokyo, Japan

[73] Assignee: Kabushiki Kaisha Daini Seikosha, Tokyo, Japan

[21] Appl. No.: 898,400

[22] Filed: Apr. 20, 1978

[30] Foreign Application Priority Data

Apr. 23, 1977 [JP] Japan ..... 52-47094

[51] Int. Cl.[3] ..... G04B 19/04; G04C 19/00

[52] U.S. Cl. ..... 368/80; 368/85; 368/217

[58] Field of Search ..... 318/696, 685; 58/23 R, 58/23 A, 23 BA, 23 D, 152 H; 340/373, 636, 663, 672; 368/76, 80, 85-87, 155-157, 217-219

[56] References Cited

U.S. PATENT DOCUMENTS

| | | | |
|---|---|---|---|
| 4,032,827 | 6/1977 | Dobratz | 318/696 |
| 4,114,364 | 9/1978 | Takahishi | 58/23 BA |
| 4,129,981 | 12/1978 | Nomoru et al. | 58/23 BA |

*Primary Examiner*—Vit W. Miska

*Attorney, Agent, or Firm*—Robert E. Burns; Emmanuel J. Lobato; Bruce L. Adams

[57] ABSTRACT

An electronic timepiece including a dividing circuit for developing different output pulse signals having different respective pulse repetition rates, a stepping motor and a drive circuit responsive to control signals for driving the stepping motor at a normal rate and for applying a correction pulse to the stepping motor according to the control signals. A pulse combining circuit combines the different output pulse signals from the dividing circuit for generating control signals and for applying the control signals to the drive circuit. The pulse combining circuit normally generates a control signal effective to drive the stepping motor at a normal rate, and the pulse combining circuit is responsive to a correction signal to control the drive circuit to apply a corrective pulse to the stepping motor. A detection circuit detects rotation and non-rotation of the stepping motor rotor and generates a detection voltage signal indicative of the state of rotation of the rotor. A voltage comparing circuit compares the detection voltage signal with a standard voltage value and applies a correction signal to the pulse combining circuit when non-rotation of the stepping rotor is detected after a drive pulse is applied to the stepping motor.

4 Claims, 18 Drawing Figures

ELECTRONIC TIMEPIECE WITH ROTATION DETECTOR

BACKGROUND OF THE INVENTION

The present invention relates to reduction of electric power consumption in an electronic timepiece, and particularly circuitry for selecting a drive pulse width which is applied to a stepping motor according to the motor load, for achieving low power consumption in the electronic watch.

DESCRIPTION OF THE PREFERRED EMBODIMENT

Figure 1:
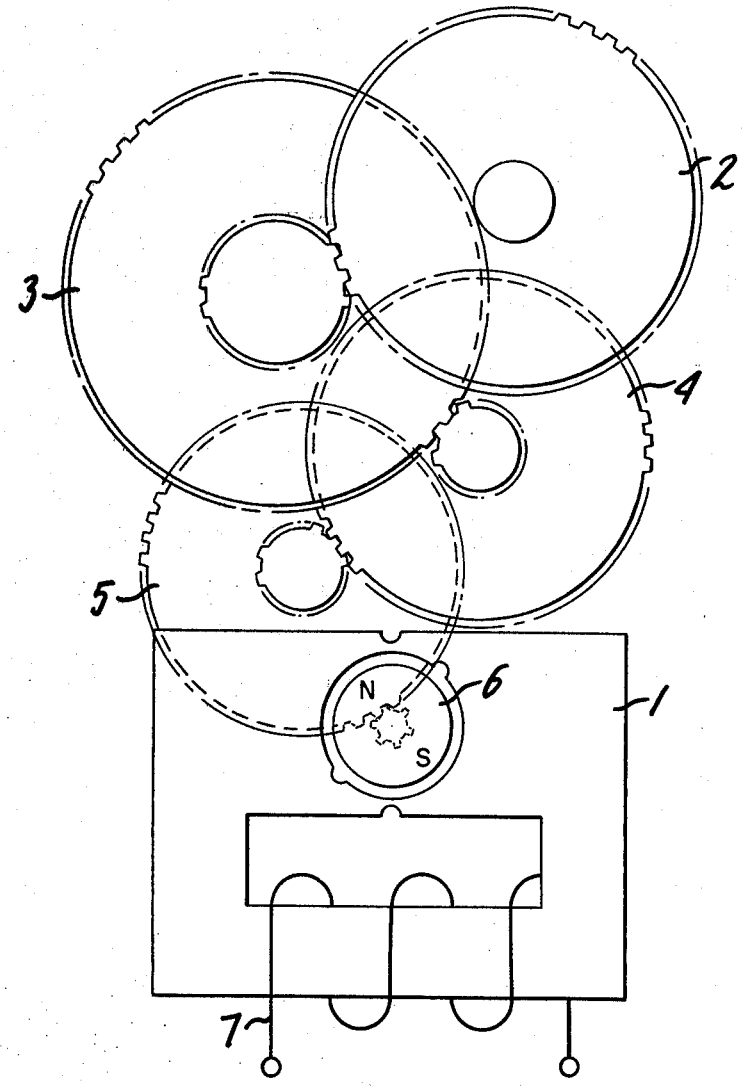
FIG. 1 shows a principle of an analogue type electronic timepiece.

The display mechanism of an analogue type crystal watch heretofore used is generally constructed as shown in FIG. 1. The output of a motor comprising a stator 1, a coil 7 and a rotor 6 is transmitted to a fifth wheel 5, a fourth wheel 4, a third wheel 3 and a second wheel 2.

Although not shown, the output is then transmitted to a cylindrical member, a cylindrical wheel, and a calendar mechanism and a second pointer, a minute pointer, an hour pointer and a calendar are driven.

In the case of a wrist watch, a load seen from the stepping motor is extremely small except for the time for switching the calendar, so that the torque of 10g/cm in the second wheel is enough for the driving. However, when switching the calendar, a torque several times higher than this is required. The time required for switching the calendar within twenty four hours operation for the day is only at most about six hours. However, for the reasons described above in the mechanism according to the prior art. there is a problem that electric power which enables the calendar driving mechanism to be operated in a stable condition must be always supplied from a power supply.

Figure 2:
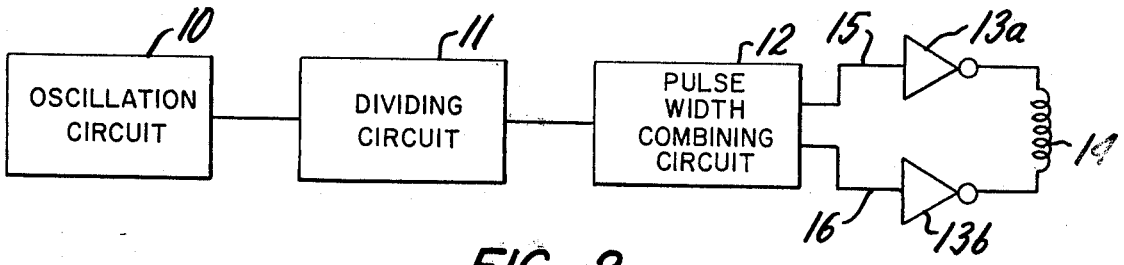
FIG. 2 shows a circuit block diagram of a conventional electronic timepiece.
Figure 3:
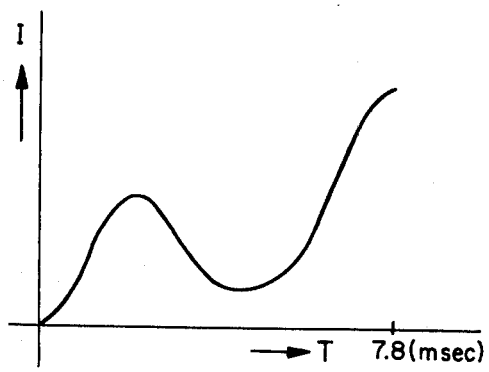
FIG. 3 shows a wave form of a coil current.

FIG. 2 shows an electronic watch circuit construction according to the prior art. The signal of 32,768KHZ from an oscillator circuit 10 is converted to a signal having a period of one second, or one second signal, by a frequency dividing circuit 11. The one second signal is converted to a signal having a pulse width of 7.8msec and a period of two seconds by a pulse width combining circuit, thus a signal pair having the same period and pulse width but being dephased by one second are applied to the inputs 15 and 16 of the inverters 13*a* and 13*b*. As a result, an inverted pulse which changes the direction of the current is applied to a coil 14 every one second, so that the rotor 6 magnetized in two poles rotates in one direction. FIG. 3 shows the current waveform. In this technique, the drive pulse width of the present day electronic watch is set by the required maximum torque as its standard. Therefore, in a time interval which does not require a large torque, electric power is wasted.

In order to overcome this difficulty and insufficiency, in the electronic watch according to the present invention, a motor is driven by a pulse having a shorter pulse width than the conventional electronic watch and afterwards a detected pulse is applied to a coil so as to determine rotation of the rotor. The rotation of the rotor is detected by a voltage level across a resistor connected in series with the coil and if the rotor fails to rotate a correction is effected by driving the motor with a pulse with a wider pulse width.

Figure 9:
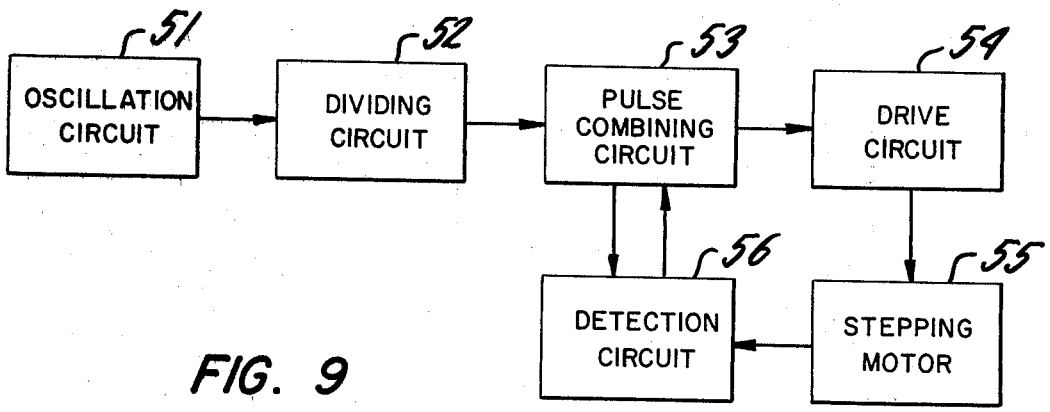
FIG. 9 shows a complete block diagram of an electronic timepiece of the present invention.

Referring now to the preferred embodiment of the present invention, FIG. 9 shows an overall block diagram of an electronic timepiece according to the present invention. Numeral 51 shows an oscillation circuit which generates an oscillating time standard signal. A frequency dividing circuit 52 is constructed by multistage flipflops which can divide down to one second for the oscillating signal required by a watch. A pulse width combining circuit 53 combines signals from each flipflop output of the frequency dividing circuit to develop a normal drive pulse signal with a pulse width necessary for the driving, a drive pulse signal for the correcting drive, a detection pulse signal with a duration necessary for the detection, a time interval setting signal between the normal drive pulse and the detecting pulse, and a time interval setting signal between the detecting pulse and the correcting drive pulse etc.

A drive circuit 54 supplies the normal drive pulse from said pulse combining circuit 53 to a stepping motor 55 and drives said stepping motor 55.

A detection circuit 56 receives a detection pulse from said pulse combining circuit 53, and detects the rotation or non-rotation of the stepping motor 55, and applies the detected output signal to said pulse conbining circuit 53.

The rotor of the stepping motor 55 is rotated by the application of the normal drive pulse when a load on the stepping motor is low. However, the rotor is not rotated when the load is high, so that it is possible to detect either the rotation condition or the non-rotation condition of the rotor from the difference of the coil, depending on the above load condition, by applying the detection signal to the detection circuit 54. Said pulse combining circuit 53 receives a signal from said detection circuit 56 and applies a correction drive pulse to said drive circuit 54. Said correction drive pulse has a longer width pulse than the normal drive pulse, whereby the stepping motor is able to obtain a high torque and to drive a high load.

Figure 4:
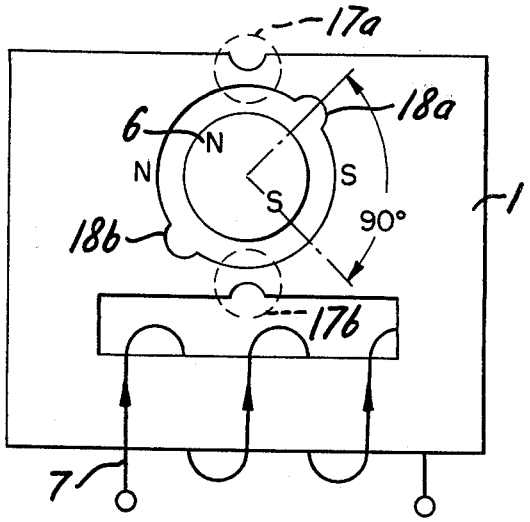
FIGS. 4 to 6 show operational principles of stepping motor.

The principle of the rotation of a stepping motor for use in the electronic watch according to the present invention is as follows:

Referring to FIG. 4, numeral 1 shows a stator constructed in one form body having a magnetic path or circuit 17 which is easily saturable. The stator is magnetically engaged with a magnetic core with the coil 7. In order to determine the direction of the rotation of the rotor 6 with two magnetic poles provided in the direction of the diameter, at least one notch 18 is provided with the stator.

In FIG. 4, the condition is shown in which electric current has just been applied to the coil 7. When no current is applied to the coil 7, the rotor 6 remains stationary at the position defining an approximately 90 degree angle between the notch 18*a*, 18*b* and the magnetic poles of the rotor. In this condition, when, in the coil 7, the current flows in the direction of the arrow mark, the magnetic poles are produced in the stator 1 as shown in FIG. 4, so that the rotor 6 rotates in the clockwise when the rotor and stator poles repel each other. When the current flowing through the coil 7 is interrupted, the rotor 6 will remain with the reversed condition in the magnetic poles of the rotor in positions opposite that of the previous condition in FIG. 4. Afterwards, the rotor 7 keeps sequentially rotating in the clockwise by flowing the current in the opposite condition.

Since the stepping motor used in the electronic watch according to the present invention is constructed with a stator in one body having saturable portion 17 (or portions 17*a*, 17*b*), the current waveform which flows through the coil 7 has a waveform with the slow rising curve as shown in FIG. 3. The reason for this is that before the saturble portion 17 of the stator 1 does not saturate, the magnetic resistance of the magnetic circuit seen from coil 7 is very small so that the time constant "$\tau$" of the series circuit of the resistor and the coil becomes very large. The equation of this condition can be expressed as follows:

$$\tau = L/R,\ L \approx N^2/RM$$

Therefore, the following equation is established:

$$\tau \approx N^2/(R \times Rm)$$

where L denotes the inductance of the coil 7: N is number of turns of the coil 7: Rm is magnetic resistance.

When the saturable portion 17 of the stator 1 is saturated, the permeability of the portion becomes the same as that of air. Accordingly, the Rm increases and the time constant $\tau$ of the circuit becomes small and the wave of the current rises abruptely as shown in FIG. 3.

According to the present invention, the detection of the rotation or non-rotation of the rotor 6 for use in the electronic wrist watch depends on the difference of the time constant of the circuit consisting of the resistor and coil connected in series. The reason for producing the difference of the time constants will now be explained hereinafter.

Figure 5:
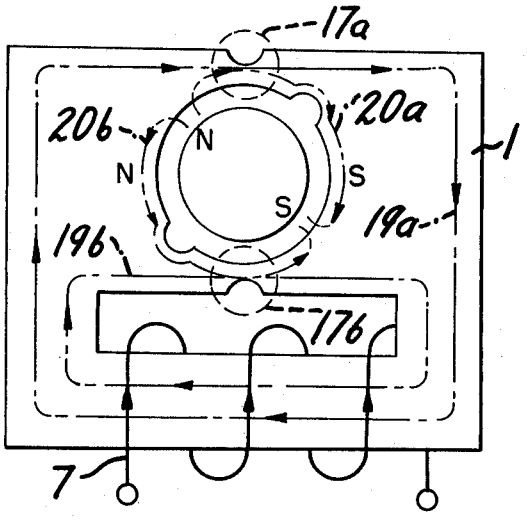

FIG. 5 shows a magnetic field condition at the time of flowing the current through the coil 7. In the figure, the rotor 6 is in a position which is rotatable, with the magnetic rotor 6 acting against the magnetic poles of the stator.

The magnetic flux 20 is the flux pattern which is derived from the rotor 6.

Figure 7:
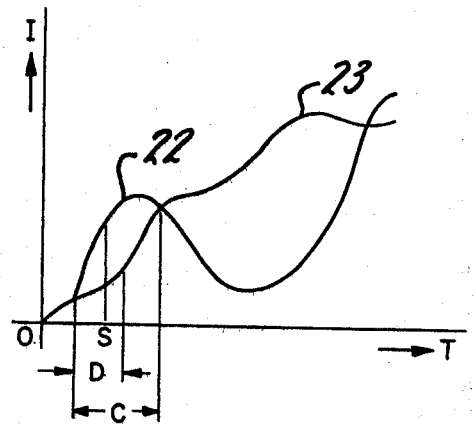
FIG. 7 shows a wave form of coil current.
Figure 8:
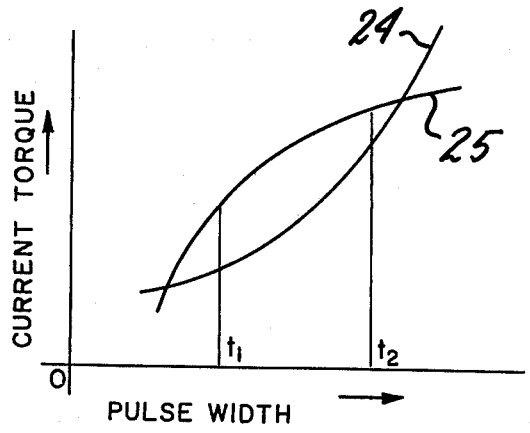
FIG. 8 shows an operating characteristic relating to drive pulse width of a motor, a current and torque.

The magnetic flux which intersects the coil 7 also exists in practice, however, that is neglected here. The magnetic fluxes 20*a* and 20*b* are shown as being derived from the saturable portions 17*a* and 17*b* of the stator 1 and they are directed in the direction of the arrow mark. The saturable portion 17 is, in most cases, not in the saturated condition. In this condition, the current flows in the direction of the arrow mark through the coil 7 so as to rotate the rotor 6 clockwise. The magnetic fluxes 19*a* and 19*b* produced by the coil 7 are added to the magnetic fluxes 20*a* and 20*b* produced by the rotor 6 within the saturable portions 17*a* and 17*b*, so that the portion 17 of the stator 1 rapidly saturates. Afterwards, a magnetic flux which is sufficient for rotating the rotor 6 is produced. However, illustration of this is omitted in FIG. 5. FIG. 7 shows the waveform of the current through the coil and is identified by numeral 22.

Figure 6:
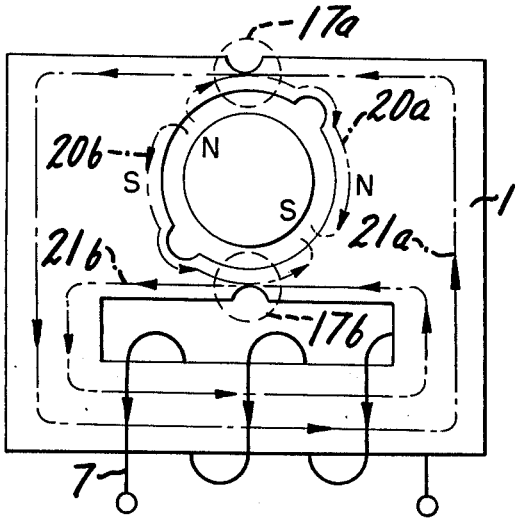

FIG. 6 shows the condition of the magnetic flux when the current flows through the coil 7 at the time when the rotor 6 could not be rotated for some reason and is returned to a rest position. Generally, in order to rotate the rotor 6, the current must flow in the coil 7 in the opposite direction to the illustrated arrow mark, i.e., in the same direction as that as shown in FIG. 5. However, in this case since an alternating inverted current is applied to the coil 7 for every rotation, this current-rotor position relationship occurs whenever the rotor 6 could not be rotated. Since the rotor 6 could not be rotated in this case, the direction of the magnetic flux from the rotor 6 is the same as the one shown in FIG. 5. In this case, since the current flows in the opposite direction against to that shown in FIG. 5, the direction of the magnetic fluxes due to the coil current become 21*a* and 21*b*.

In the saturable portions 17*a* and 17*b*, the magnetic fluxes produced respectively from rotor 6 and the coil 7 cancel each other, so that in order to saturate the narrow portion of the stator 1, a longer time is required. FIG. 7 shows the coil current for this condition and is identified by numeral 23. In this embodiment, the time interval "D" before the portion 17 of the stator 1 saturates in FIG. 7, was 1 msec. for the case that the diameter of the coil is 0.23, the number of turns is 10,000, the coil series resistance is 3KΩ, the diameter of the rotor is 1.3 and the minimum width of the saturable portion is 0.1. As is apparent from the waveforms 22 and 23 of the two currents shown in FIG. 7, the inductance of the coil is small when the rotor 6 is rotating within the range of "C" in FIG. 7 while it is large at the time of non-rotation. In the stepping motor as described above, the equivalent inductance in the range of "D" was chosen as L =5 henry at the current waveform 22 when rotating, and was chosen as L =40 henry at the waveform 23 during non-rotation.

A voltage which is generated at both terminals of the detection element when connected a direct current resistance "RΩ" of the coil and the switching element and the resistor rΩ as a detection element is obtained by the following equation $$V = r/(R+r)\ [1 - \mathrm{Exp}\ (-(R+r) \cdot t/L)]\ VD$$

It is able to detect a change of a voltage "V" of a detection element according to a change of inductance "L".

Therefore, if a threshold voltage of a binary logic circuit is "Vth" and V=Vth, it is able to detect a difference of inductance "L". Further, in the above noted formula, if a threshold voltage "Vth" is able to change according to a change of power source voltage "VD", it is possible that the detection circuit is not affected by a change of power source voltage.

It is able to a CMOS inverter for discriminating the voltage. The threshold voltage of the inverter becomes equal to: $Vth=[\alpha(VD-VTP)+VTN]/(1+\alpha)$, if the threshold voltage of a PMOSFET is VTP, the threshold voltage of a NMOSFET is VTN, the scale of a P-channel transistor is Kp, a scale of a N-channel transistor is KN, $\alpha=\sqrt{10/KN}$ and the power source voltage is VD.

In the above noted formula, in the case of $\alpha=VTP/VTN$, $Vth=\alpha/(1+\alpha)$, the threshold voltage of a CMOS inverter Vth is proportional to the power source voltage VD, however said voltage Vth is not proportional in any other parameter. Namely, according to the fabrication process of an IC, a threshold voltage VTN of the NMOSFET and a threshold voltge VTP of the PMOSFET are changed, a threshold voltage Vth the CMOS inverter is shifted from a preset or desired value, and a threshold voltage Vth of the CMOS inverter is not proportional to a change of power source voltage VD, and further a detection level is changed together with a change of power source voltage.

According to the present invention, the threshold voltage Vth is changed in proportional to a change of power source voltage VD, and further, the threshold voltage "Vth" is obtained by dividing the power source voltage "VD" by two resistors for eliminating an influence which is caused by an irregularity in the IC fabrication process, and a comparator is used as a binary logic circuit. As a consequence, a change of said threshold voltage "Vth" is clearly eliminated. Further, it is possible to accurately set the threshold voltage "vth" by setting said "Vth" according to a ratio of the resistor values and, it is able possible to obtain a broad allowance of a detection resistor element value.

Figure 10:
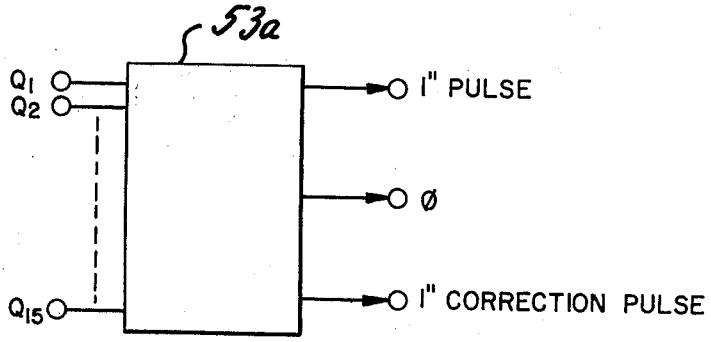
FIG. 10 shows a pulse combining circuit block diagram.

Referring now to the pulse combining circuit 53, the driving circuit 54 and the detection circuit 56:

FIG. 10 shows a time chart and a block diagram of said pulse combining circuit 53, and shows the 1 sec. pulse, 1 sec. correction pulse and detection pulse $\phi$ outputs above noted signals are easily combined by combining outputs "Qn" of said dividing circuit 52. The Qn outputs are combined according to the following equations:

1 sec. pulse $=Q8, Q9, Q10, Q11, Q12, Q13, Q14$ and $Q15$ 1 sec. correction pulse $=\overline{Q9}, \overline{Q10}, Q11, \overline{Q12}, \overline{Q13}, \overline{Q14}$ and $\overline{Q15}$ $\phi=Q5, Q6, Q7, Q8, Q9, Q10, \overline{Q11}, \overline{Q12}, \overline{Q13}, \overline{Q14}$ and $\overline{Q15}$ $Q5$: 1024Hz, $Q4$: 512Hz . . . . $Q15$: 1Hz Therefore, the pulse widths of said signals are as follows:

1 sec. pulse: 3.9 msec., 1 sec. correction pulse: 7.8 msec.

$\phi$: 0.5 msec.

Figure 12:
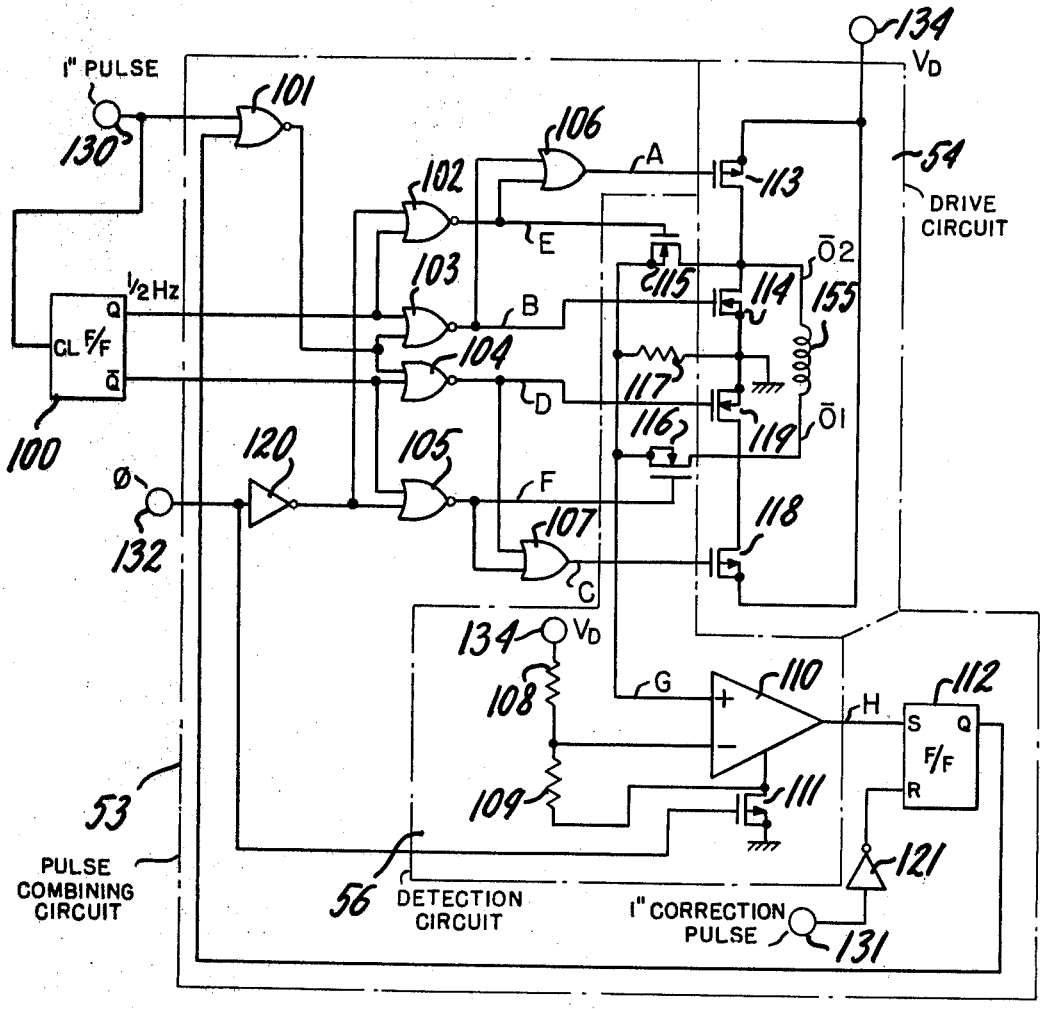
FIG. 12 shows circuit structure of the pulse combining circuit, detection circuit according to the present invention and drive circuit.
Figure 13:
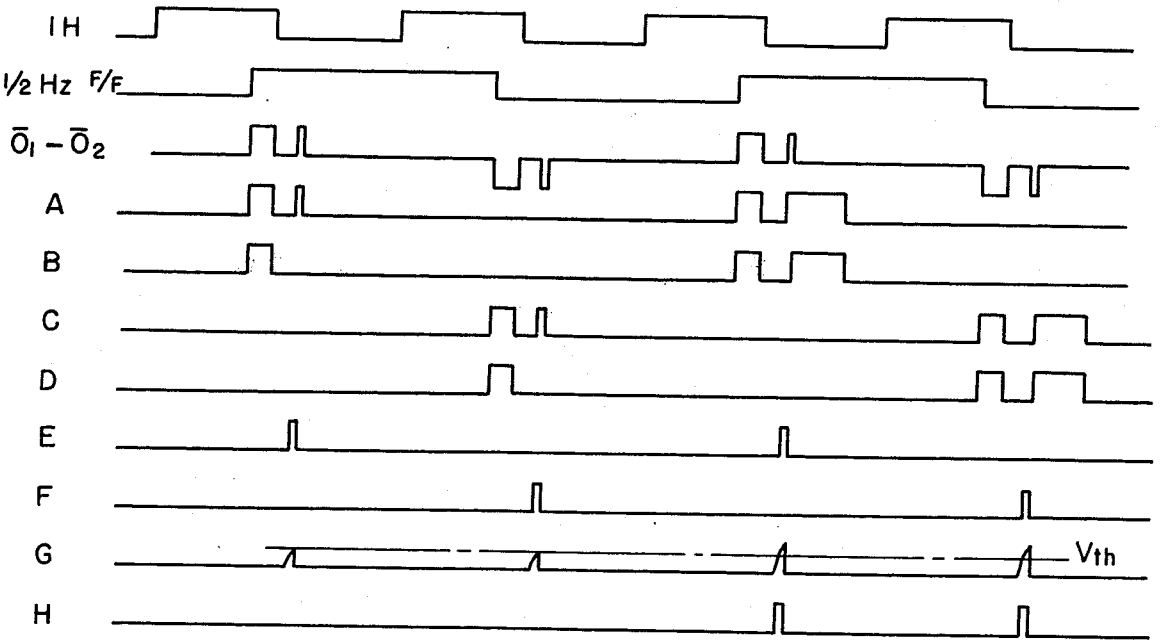
FIG. 13 shows a time chart of said circuits of FIG. 12.

These signals are applied to a circuit illustrated in FIG. 12 and changed to a suitable signal for driving said drive circuit 54.

Figure 11:
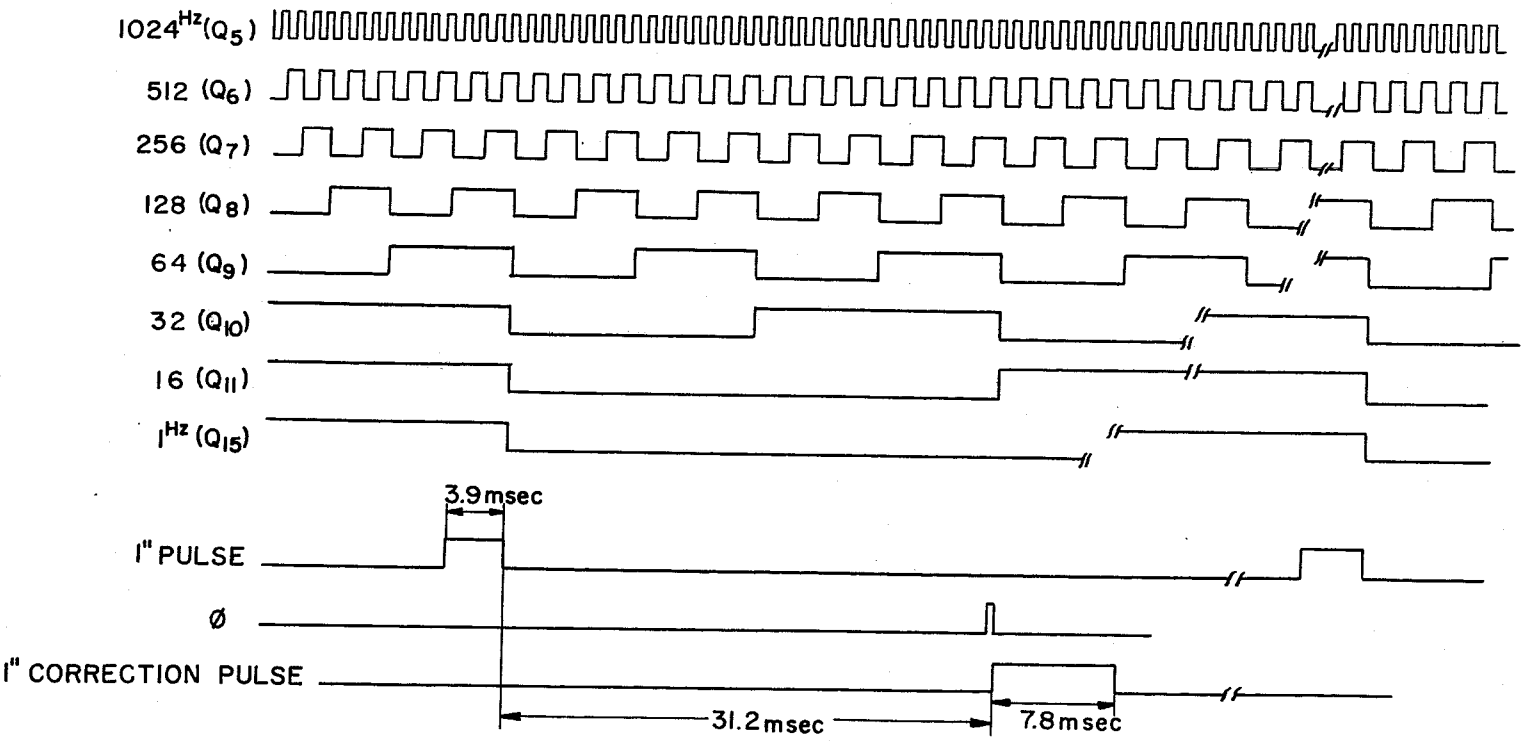
FIG. 11 shows a time-chart of said pulse combining circuit block diagram.

FIG. 11 shows one embodiment of said pulse combining circuit 53, driving circuit 54 and detection circuit 56.

Numeral 100 is a flip-flop for generating a ½Hz signal, an output of said flip-flop 100 is connected to NOR-gates 102 and 103, a complementary output of said flip-flop 100 is connected to a first input or NOR-gates 104 and 105. The 1 sec. pulse is applied to NOR-gate 101, further the 1 sec. correction pulse is applied from R—S flip-flop 112 to NOR-gate 101 in the case of non-rotation of the rotor, and an output of said NOR-gate 101 is applied to a second input of NOR-gates 103 and 104.

A detection pulse "$\phi$" from the output of said pulse combining circuit 53 is applied to the second inputs of NOR-gates 102 and 105 through an inverter 120, and is applied to a gate of the NMOSFET 111 for inhibitting a comparator 110.

An output of NOR-gate 102 is connected to the first inputs of NMOSFET 115 and OR-gate 106.

An output of NOR-gate 103 is connected to an input of NMOSFET 114 for driving a stepping motor and to a second input of OR-gate 106.

An output of NOR-gate 104 is connected to an input of NMOSFET 119 for driving a stepping motor and to a first input of OR-gate 107.

An output of NOR-gate 105 is connected to the second inputs of NMOSFET 116 and OR-gate 107.

An output of OR-gate 106 is connected to PMOSFET 113 for driving a stepping motor, OR-gate 107 is connected to PMOSFET 118 for driving a stepping motor.

The 1 sec. correction pulse is applied from a terminal 131 to a reset terminal of the R-S flip-flop 112 through an inverter 121.

The above described structure is the contents of said pulse combining circuit 53, said drive circuit 54 and detection circuit 56.

Numeral 134 is a positive terminal of a power source, a power source voltage "VD" is applied thereto, and a source of PMOSFET 113 is connected to a source of PMOSFET 118 and to the positive power terminal 134.

The sources of NMOSFETS 114 and 119 are grounded, the drains of P and MNOSFETS 113 and 114 are connected to each other, said NMOSFETS 114 and 119 are connected to a coil 155 of said stepping motor 55 and a drain of a detection NMOSFET 115. The drains of P and NMOSFETS 118 and 119 are connected to each other, and said P and NMOSFETS 118 and 119 are connected to the other terminal of the coil 155 and a drain of a detection NMOSFET 116.

The source electrodes of N MOSFETS 115 and 116 are connected to each other, and their connection point is connected to one terminal of a resistor 117. The other terminal of said resistor 117 is connected to ground. Said connection point of NMOSFETS 115, 116, and resistor 117 is connected to a positive input terminal. One terminal 134 of the resistor 108 is connected to the power source voltage "VD", the other terminal of said resistor 108 is connected to the resistor 109, the connection point thereof is connected to a negative input terminal of the comparator 110. The other terminal of said resistor 109 is connected to a drain electrode of NMOSFET for inhibitting a detection, and is connected to the ground through a source electrode. A ground terminal of the comparator 110 is connected to a drain electrode of NMOSFET 111, and is connected to the ground through a source electrode. An output of the comparator 110 is connected to a set terminal of the R-S flip-flop.

Referring now to the operation of the present invention:

In case of "H" level output of the output "Q" of F/F100, NOR-gate 104 becomes "H" when NOR-gate 101 output is "L" whereby OR-gate 107 output becomes "H", PMOSFET 118 becomes "OFF", and NMOSFET 119 becomes "ON".

At this time, a current flows to the coil 155 and the stepping motor is operated. In case of "L" level output of output "Q" of F/F 100, a current in opposite direction flows to the coil according to the "ON" condition of NMOSFET 114 whereby the stepping motor is operated.

In the case of a detection pulse "$\phi$" being applied to a terminal 132, an output of NOR-gate 105 becomes "H" when an output "Q" of F/F100 is "H", a current flows to PMOSFET 113, coil 155, NMOSFET 115, resistor 117 and ground, whereby a voltage drop is developed across both terminals of said resistor 117.

Figure 14:
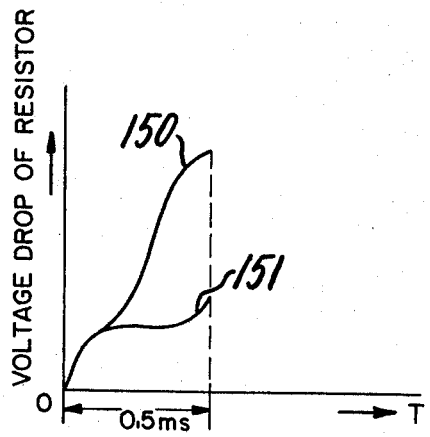
FIG. 14 shows a characteristic of a voltage drop-time of a detection resistor.

Therefore, a voltage as shown by the wave-shape "151" of FIG. 14 in the case rotation of the rotor in response to the 1 sec. pulse signal occurs, is developed. On the contrary, a voltage as shown by the wave-shape 150 of FIG. 14 occurs, in the case of non-rotation of the rotor. Further, it is possible to obtain an output signal of the comparator as a rotation signal or a non-rotation signal by preferably determining a threshold voltage of the comparator at a voltage between both wave shapes 150 and 151 illustrated in FIG. 14 and within the 0.5 msec. time interval illustrated.

In case of non-rotation, an output of the comparator 110 becomes "H". R-S F/F is set, an output "Q" becomes "H", whereby a correction drive is maintained by a correction pulse. In case of "L" level of output "Q" of F/F100, the same operation is attained. An electric current always flows to a dividing resistor and comparator, a necessary time for a detection is only about 0.5 m sec. in each second, and it is able to reduce the current for detection to a minimum by using an inhibit circuit for inhibitting the current for the comparator and dividing resistor except during a detection time. A necessary time for a comparation shorter than the detection pulse "$\phi$" is very preferable and is clearly shown in a wave-shape of FIG. 12.

Figure 15:
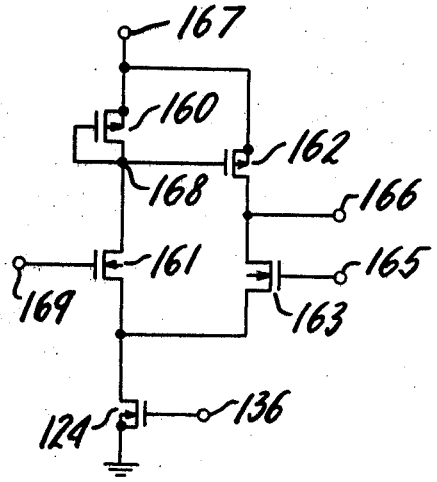
FIGS. 15 and 16 show a comparator circuit.
Figure 16:
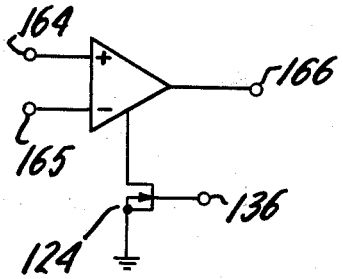

Referring now to the construction and operation of the comparator 123 which is constructed of CMOS, i.e. the main feature of the present invention:

FIG. 15 shows one embodiment of the comparator 123. A terminal 164 is a positive input terminal, a terminal 165 is a negative terminal, a terminal 166 is an output terminal, a terminal 136 is an "ENABLE" terminal.

The function and operating mode of the comparator is as follows:

TABLE 1

| POSITIVE INPUT | NEGATIVE INPUT | ENABLE TERMINAL | OUTPUT TERMINAL |
|---|---|---|---|
| — | — | 0 | — |
| V+ > | V− | 1 | H |
| V+ < | V− | 1 | L |

Numeral 167 is a power source terminal, and is connected to the source electrodes of PMOSFETS 160 and 162. A gate and a drain electrodes of PMOSFET 160 are connected to each other, the connection point thereof is connected to a gate of PMOSFET 162 and a drain of NMOSFET 161.

A gate of NMOSFET 161 is connected to a terminal 169, a source electrode thereof is connected to a drain electrode of NMOSFET 124. A drain electrode of PMOSFET 162 is connected to a drain electrode of NMOSFET 163 and output terminal 166.

A gate of NMOSFET 163 is connected to a terminal 165, a source electrode thereof is connected to a drain electrode of NMOSFET 161. A source electrode of NMOSFET 124 is connected to the ground, a gate electrode of said NMOSFET 124 is connected to the terminal 136. The characteristics of NMOSFETS 160 and 162 are equal respectively.

Figure 17:
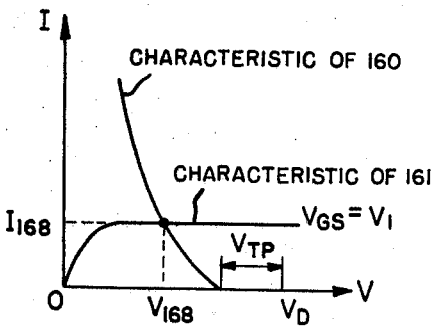
FIGS. 17 and 18 show characteristics of FETS of said comparator.

Referring now to the operation of the comparator of the above noted construction:

NMOSFET 124 turns "OFF" when "ENABLE" terminal 136 is "L" level, whereby said comparator is not operated. Further NMOSFET 124 turns "ON" when the terminal 136 is "H" level, whereby said comparator is operated. A voltage and current of a connection point 168 become as shown in FIG. 17 when an input voltage "V" is applied to the terminal 164. "V168" is a voltage of the terminal 168, "I168" is a current which flows the terminal 168.

Said "V168" is applied to a gate of PMOSFET 162, whereby a saturated current is equal to "I168". Said condition relating to said current "I168" is shown in the characteristic of FIG. 18.

If a voltage which is applied to a terminal 165 is "$V_2$", a saturated current of NMOSFET 163 becomes larger in the case $V_2 > V_1$. Therefore, a voltage "V166" of the output terminal 166 becomes in the neighbourhood of "L" level. Said condition is shown by a mark "X" in FIG. 18.

Figure 18:
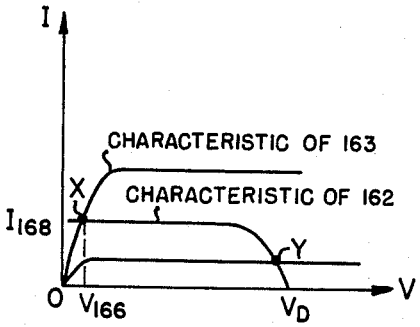

On the contrary, in the case $V_2 > V_1$, an output "V166" becomes "H" level, said condition is shown by "Y" in FIG. 18, therefore, a function of said comparator becomes as shown in TABLE 1.

According to the present invention, a rotor is rotated by a short drive pulse in case of a light load condition, a long drive pulse is applied to a stepping motor only during a time when said rotor is not rotated by said short drive pulse in case of a heavy load condition, whereby it is able to drive a load and a power consumption is remarkably reduced in comparison to a conventional type driving circuit.

Further, it is possible to construct the circuit of the present invention into an "IC", and it is possible to eliminate an influence of irregularity of power voltage, change of the temperature and fabrication process of the "IC" since a threshold voltage of a binary logic circuit is obtained by dividing a power voltage with a resistor, whereby it is possible to obtain a sufficient tolerance for the detection resistor and to construct the circuit of the present invention with a diffusion resistor of the "IC".

Therefore, it is very easy to construct the circuit of the present invention by circuit integration and to eliminate a factor of cost increase, whereby it is possible to attain low power consumption in an electronic timepiece.

Irrespective of the kind of motor, an electronic timepiece which has a motor which exhibits a difference of inductance of the motor coil in case of rotation or non-rotation of rotor is included to the present invention.

We claim:

1. In an electronic timepiece:

an oscillator circuit for generating an oscillating time standard signal;

a dividing circuit for dividing the time standard signal and for developing different output pulse signals having different respective pulse repetition rates;

a stepping motor having a rotor and a coil;

a drive circuit responsive to control signals for driving said stepping motor at a normal rate and for applying a corrective pulse to said stepping motor according to the control signals;

pulse combining circuit means for combining the different output pulse signals from said dividing circuit for generating the control signals and for applying the control signals to said drive circuit, said pulse combining circuit means normally generating a control signal effective to drive said stepping motor at a normal rate and said pulse combining circuit means responsive to a correction signal to control said drive circuit to apply a corrective pulse to said stepping motor;

detecting circuit means for detecting rotation and nonrotation of said stepping motor rotor and for generating a detection voltage signal indicative of the state of rotation of said stepping motor rotor; and voltage comparing circuit means for comparing the detection voltage signal with a standard voltage value and for applying a correction signal to said pulse combining circuit means when non-rotation of said stepping motor rotor is detected after a drive pulse is applied to said stepping motor.

2. In an electronic timepiece as claimed in claim 1, said detection circuit means comprising: a resistor; and means comprised of a switching element and responsive to a control signal from said pulse combining circuit means for connecting said resistor to said drive circuit to develop a voltage thereacross determined by a current flowing through said motor coil during a short predetermined time interval following application of a drive pulse to said stepping motor.

3. In an electronic timepiece as claimed in claim 1 or 2, said voltage comparing circuit means comprising:

a pair of P-MOS field-effect transistors each having respective source, drain and gate terminals, said source terminals connected together for receiving a power source voltage in use, the gate and drain terminals of a first of said P-MOS field-effect transistors connected together and to the drain terminal of the second of said P-MOS field-effect transistors;

a first N-MOS field-effect transistor having a drain terminal connected to the drain terminal of said first P-MOS field-effect transistor, a gate terminal defining a comparator input terminal, and a source terminal;

a second N-MOS field-effect transistor having a drain terminal connected to the drain terminal of said second P-MOS field-effect transistor and defining a comparator output terminal thereat, a gate terminal defining a second comparator input terminal, and a source terminal connected to the source terminal of said first N-MOS field-effect transistor and to ground in use.

4. In an electronic timepiece as claimed in claim 3, said voltage comparing circuit means further comprising: a third N-MOS field-effect transistor having a drain terminal connected to the respective source terminals of said first and second N-MOS field-effect transistors, a source terminal connected to ground in use, and a gate terminal connected to receive a control signal from said pulse combining circuit means for enabling said voltage comparing circuit means only during a short predetermined time interval following application of a drive pulse to said stepping motor.

* * * * *